US008043139B2

(12) United States Patent
Jobe

(10) Patent No.: US 8,043,139 B2
(45) Date of Patent: Oct. 25, 2011

(54) START SWITCH FOR GRAVITY-DRIVEN CARS

(76) Inventor: John Dewey Jobe, Missouri City, TX (US)

( * ) Notice: Subject to any disclaimer, the term of this patent is extended or adjusted under 35 U.S.C. 154(b) by 225 days.

(21) Appl. No.: 12/455,796

(22) Filed: Jun. 5, 2009

(65) Prior Publication Data

US 2010/0311306 A1 Dec. 9, 2010

(51) Int. Cl.
*A63H 18/00* (2006.01)
*A63H 29/00* (2006.01)

(52) U.S. Cl. ..... 446/429; 446/444

(58) Field of Classification Search ..... 446/168, 446/173, 174, 444–446, 429, 430; 463/58, 463/59, 69
See application file for complete search history.

(56) References Cited

U.S. PATENT DOCUMENTS 3,502,332 A * 3/1970 Wolf ..... 463/69
3,648,454 A * 3/1972 Morrison ..... 368/2
4,108,437 A * 8/1978 DeAnda et al. ..... 463/59
5,575,383 A * 11/1996 Seeley ..... 206/217
6,424,598 B1 * 7/2002 Shultz ..... 368/3
6,664,887 B1 * 12/2003 Fuchs ..... 340/309.16
7,241,223 B1 * 7/2007 Caudill ..... 463/62
7,285,035 B1 * 10/2007 Tullis ..... 446/444
7,651,398 B2 * 1/2010 Ostendorff et al. ..... 463/60

* cited by examiner

*Primary Examiner* — Gene Kim
*Assistant Examiner* — Alyssa Hylinski

(57) ABSTRACT

This invention relates to gravity-driven car racing, specifically an improved electrical timing start switch for race tracks such as used in the popular Pinewood Derby race. The present invention eliminates the imprecise coupling between the mechanical release of start posts and the subsequent generation of an electrical timer start signal by a separate micro switch-based contact. The micro switch is eliminated and the start post trigger release mechanism itself is insulated and wired as a normally closed contact that will essentially immediately start the race timer when activated. The difference in the time the start posts begin to move and the time the trigger "switch" activates the timer is then reduced to an extremely short and precise time. This time is that for mechanical movement propagation from the trigger release point to the start posts, only about 20 millionths of a second for a one lane track.

4 Claims, 5 Drawing Sheets

FIG. 2
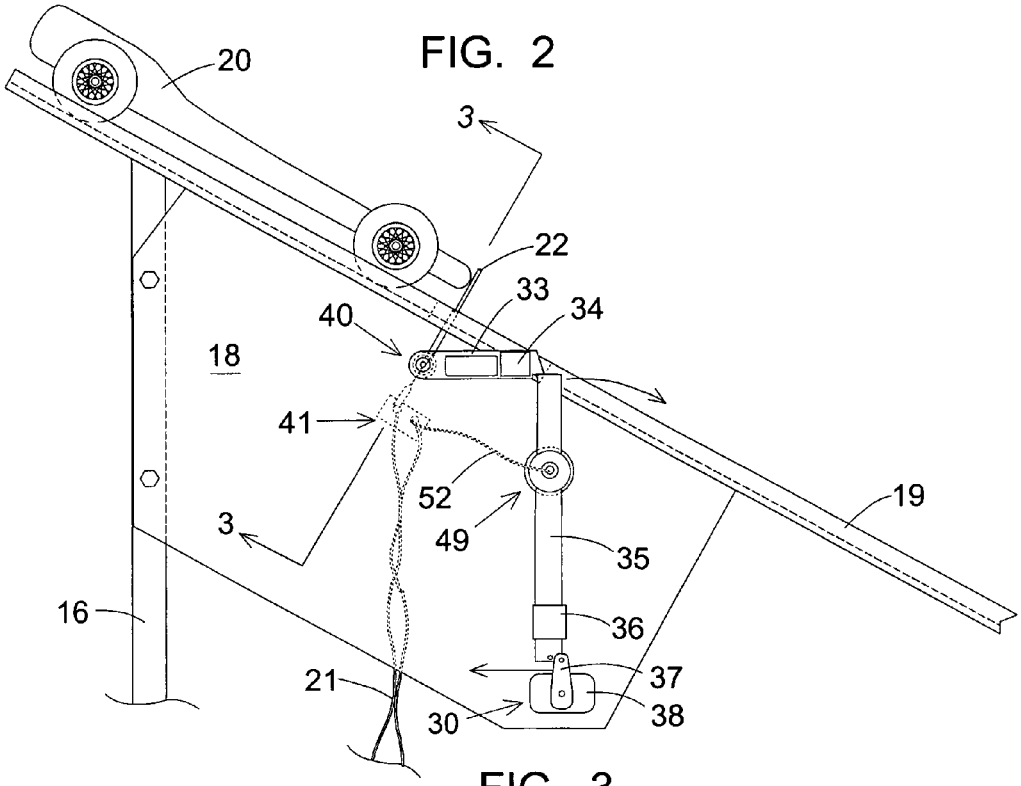
FIG. 3
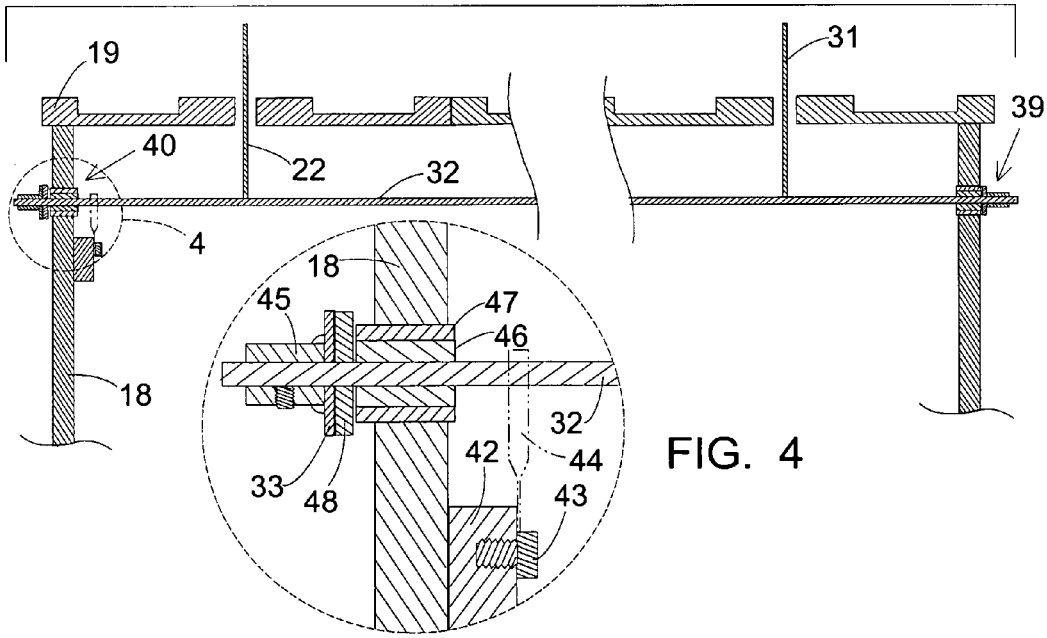
FIG. 4

FIG. 5
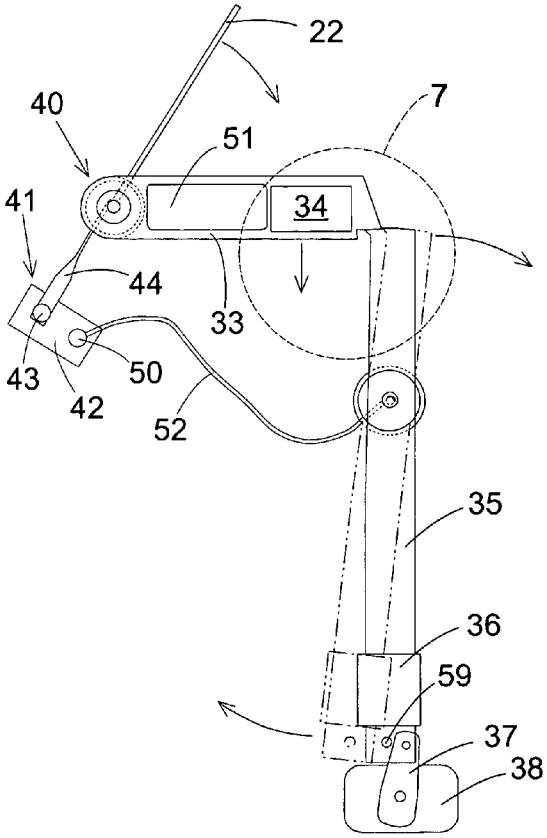
FIG. 6
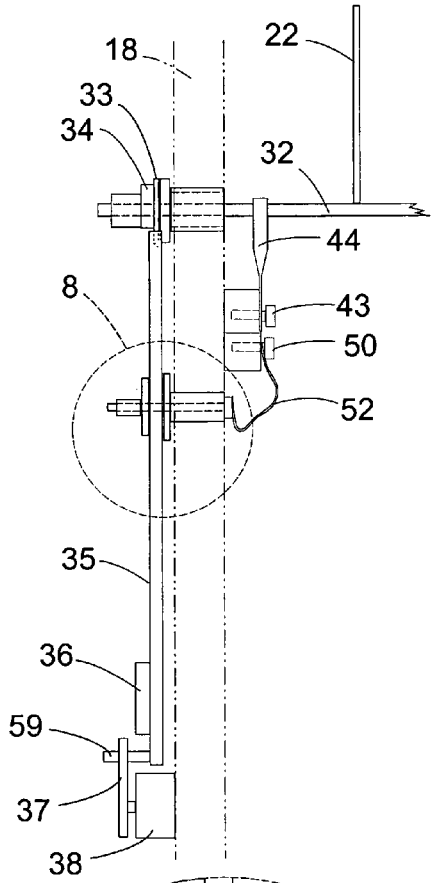
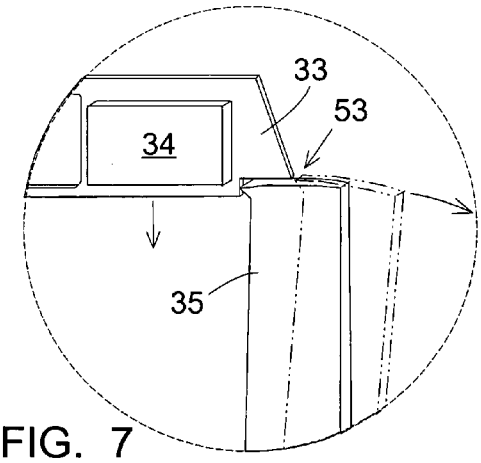
FIG. 7
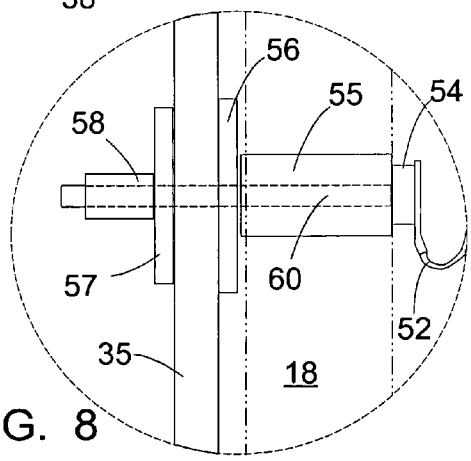
FIG. 8

START SWITCH FOR GRAVITY-DRIVEN CARS

CROSS REFERENCE TO RELATED APPLICATIONS

This application claims the benefit of patent application Ser. No. 12/321,320 filed Jan. 16, 2009 by the present inventor, which is incorporated herein by reference.

FEDERALLY SPONSORED RESEARCH

Not Applicable

SEQUENCE LISTING OR PROGRAM

Not Applicable

BACKGROUND

1. Field of the Invention

This invention relates to gravity-driven car racing, specifically an improved electrical timing start switch for race tracks such as used in the popular Pinewood Derby race.

2. Prior Art

Millions of Pinewood Derby races have been run since the inception of the race in 1953, mostly by Cub Scouts and their parents. But the currently available race tracks have a problem in the way electrical car start timers are turned on. Refer to the prior art FIG. 1 which points out a typical start mechanism, a version of which is shared by all prior art tracks. The typical location of a start gate is at the top of an initial elevated track portion called a ramp. A spring force is supplied by strong rubber bands or a spring arrangement such as shown in FIG. 1. When trigger action allows the start posts to rotate, thus releasing the cars, the lever of a common micro switch is released by the start post support bar. The movement of the micro switch lever applies or releases pressure that activates an internal snap-action contact closure inside the micro switch. This final action then triggers an electronic race timer. So first there is a start post support bar release, such movement in turn moving the micro switch lever, and then this lever causing in turn compression or release of the internal snap-action switch. This sequence of events leads to inaccurate start times. In such a conventional start switch arrangement, there is substantial variability in the time elapsed from the instant the start posts allow gravity forces to begin to move the cars until the micro switch contacts send a start signal to the race timer. Race winners can be decided by timer differences on the order of a tenth of a millisecond, and the prior art spread in race starting times may typically be tens of milliseconds. This variability can lead to an undesirable spread in race times for repeat runs of a car down the track. Thus, the true performance capability of a car may not be recorded. Also, simulation models of gravity cars are constantly improving, and these require precise initial conditions that force begins when time begins. Thus the measured start time data used to test the models needs to be accurate.

Referring again to prior art FIG. 1, we see that the items associated with the prior art start gate are mounted on a brace 17 or on other ramp member such as a main support leg 16 or the side of the ramp 19. A plurality of start posts 22 are supported by a wooden or metal bar 23 which is mounted to the ramp underside by a hinge with pivot 24. A lever 25 supports the bar 23 in a cocked position as shown with spring 26 stretched. Whenever the lever 25 is moved in the arrow direction, the bar 23 rotates around hinge pivot 24, allowing a micro switch lever 28 at the bottom of the start micro switch 27 to drop. This drop causes the internal contacts in the micro switch to send a start signal to a race timer through the wire pair 21. The lever 28 has flexure and there may be variations in the positioning of the micro switch itself relative to the bar 23. These also add uncertainties in the timing start signal turn on relative to the actual motion onset of car 20.

SUMMARY

The present invention eliminates the imprecise coupling between the mechanical gravity start and a corresponding electrical micro switch-based start signal. The gravity starting trigger mechanism itself is configured as an insulated normally closed contact that will immediately start the race timer when opened. The difference in the time when the start posts allow the car to move and the time such a trigger "switch" activates the timer is then reduced to an extremely short and precise time. This time is that taken for the twisting action of a solid mechanical drop member to propagate from the trigger release point to the starting post /car nose contact point. This delay can be estimated, from the speed of sound in the drop member and post material, to be only 20 millionths of a second for a one lane track.

DRAWINGS—FIGURES

FIG. 2 shows the layout of the pendulum start gate and wiring for the trigger start switch.

FIG. 3 shows a sectional view of FIG. 2 perpendicular to the track through the start posts.

FIG. 4 shows an enlargement of the journal bearing supporting the start post support rod.

FIG. 5 shows details of the trigger lever being released.

FIG. 6 shows a side view of FIG. 5.

FIG. 7 shows an enlargement of the trigger release from FIG. 5.

FIG. 8 shows an enlargement of the journal bearing supporting the trigger release lever.

DRAWINGS—REFERENCE NUMERALS

| | |
|---|---|
| 16 main ramp support leg | 17 leg brace |
| 18 mount plate for start gate | 19 ramp side view |
| 20 gravity-driven car | 21 start micro switch wires to timer |
| 22 start post | 23 start post support bar |
| 24 hinge pivot | 25 start lever |
| 26 spring | 27 start switch body |
| 28 micro switch start lever | 29 spring assisted drop member |
| 30 transducer assembly | 31 final of plurality of start posts |
| 32 metal start post support rod | 33 metal drop member |
| 34 drop member weight | 35 metal trigger lever |
| 36 trigger lever weight | 37 transducer lever |
| 38 transducer or solenoid | 39 support rod journal bearing assembly |
| 40 drop member journal bearing assembly | 41 wiring terminal block assembly |
| 42 wiring terminal block | 43 first terminal screw |

-continued

| | |
|---|---|
| 44 twisted metal contact strip | 45 collar |
| 46 first plastic insulating bushing | 47 metal insert |
| 48 first plastic insulating washer | 49 trigger lever journal bearing |
| 50 second terminal screw | 51 drop member cut out area |
| 52 electrical wire to second terminal screw | 53 contact area on tip of trigger lever top |
| 54 head of shoulder bolt | 55 second plastic insulating bushing |
| 56 second plastic insulating washer | 57 washer |
| 58 restraining nut or collar | 59 trigger lever pin |
| 60 shoulder bolt | 61 signal inverter |
| 62 alternate wire to start post support rod | 63 impact pad |

DETAILED DESCRIPTION OF A PREFERRED EMBODIMENT—FIGS. 2-8

Start Gate Mechanical Description—FIGS. 2, 3, 4, 5 and 6

Figure 1:
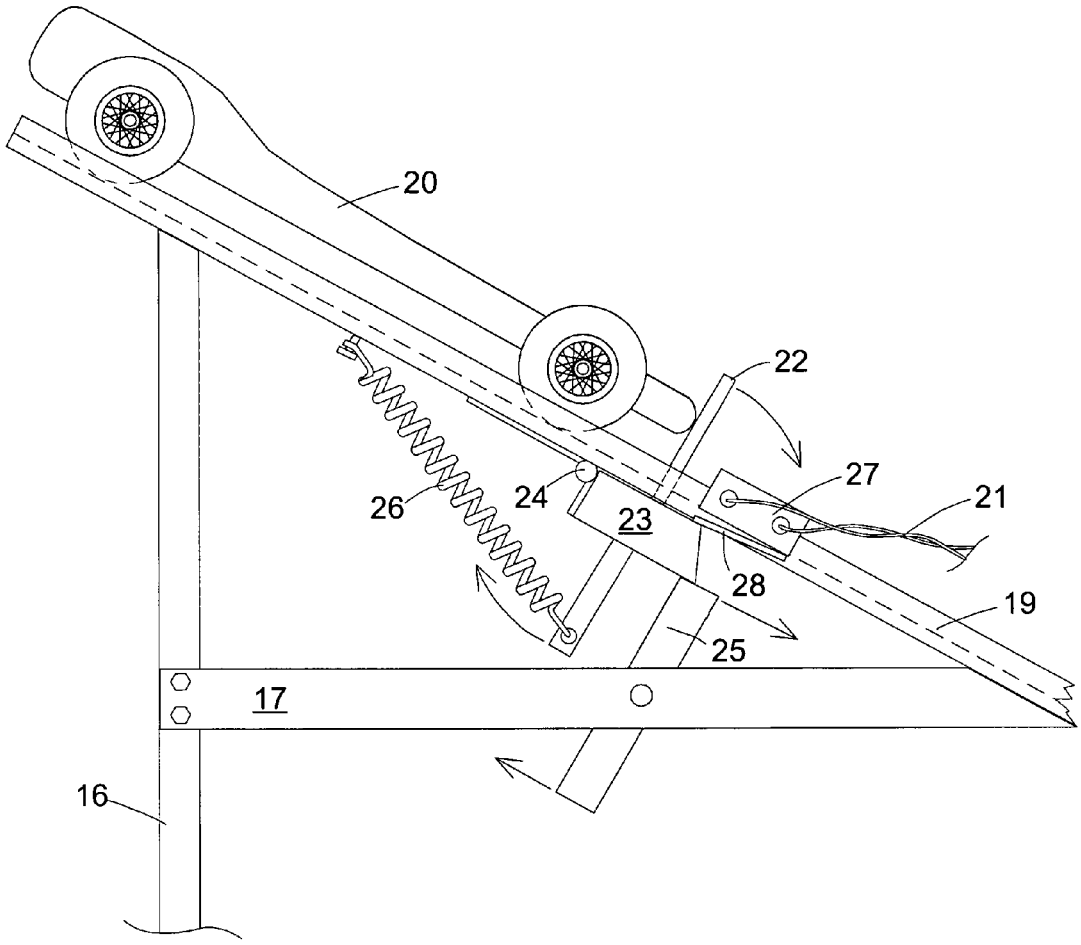
FIG. 1 Prior Art
FIG. 1 shows prior art associated with a car start gate.

This application can best be appreciated by referring to the related application Ser. No. 12/321,320 which is now pending. This earlier application also deals with a start gate improvement, but from a mechanical rather than electrical perspective. This earlier application replaces the prior art spring, FIG. 1, with a natural gentle motion of the pendulum assembly after the trigger is released. This eliminates the bar 23 "slap" against the bottom of the ramp which jostles the cars 20. The patent applications were separated because either the previous mechanically related application or the present electrical based application can be applied independently to improve the prior art.

Thus, patent application Ser. No. 12/321,320 should be consulted for a full mechanical description of the start gate. Some mechanical details will be reviewed herein as the connection between electrical and mechanical performance is related. The start gate in a holding or cocked state is shown in FIG. 2 along with a sectional view in FIG. 3. A main ramp support leg is 16 and a side view of the top of the ramp is 19. As in prior art, the start gate parts are mounted on a solid brace or a plate or board 18 that is securely attached to a support leg 16 and ramp 19. A gravity-driven car side view is 20, with the car nose resting against start post 22.

Also shown in FIG. 2, the start gate comprises a combination of 1) a pendulum assembly and 2) a movable holding means for this assembly. The pendulum assembly, a rigid swingable assembly, is comprised of a drop member 33, a post support rod 32, and a plurality of start posts 22 through 31. A key part of the pendulum assembly is the drop member 33, whose left end is rigidly joined to the start post support rod 32. In FIG. 3, the post support rod 32 is shown passing, as a rotation axis, through the center of a journal bearing assembly 40 which is shown in detail in FIG. 4. The entire pendulum assembly has an effective center of mass close to the center of a weight 34 mounted on the right end of the drop member 33. Post support rod 32 is supported at the right end by journal bearing assembly 39. Both bearings 39 and 40 are also considered as a part of the start gate. The pendulum assembly, after being released, swings freely. In addition to the pendulum assembly and bearings, the start gate includes a movable holding means. In the preferred embodiment of application Ser. No. 12/321,320 the holding means is trigger lever 35. Trigger lever 35 is shown in a vertical cocked state, with a second weight 36 on its lower end. The lever 35 can be rotated around a journal bearing assembly 49. The trigger lever 35 may be remotely moved by an electromechanical transducer assembly 30. Thus a transducer 38 and its lever 37 can cause the required movement of trigger lever 35 by pushing against the trigger lever 35 bottom according to the motion arrow to the left. For detail of a trigger lever pin 59 pushed by the transducer lever 37, see FIGS. 5 and 6.

An enlarged view of the journal bearing assembly 40 is shown in FIG. 4. The start post support rod 32 protrudes through an insulating plastic journal bushing 46 with appropriate clearance for ease of rotation. The journal bushing 46 fits into a cylindrical metal insert 47 suitable for insertion into a hole placed in the bulk of the mounting plate 18. An insulating plastic washer 48 is just inside the end view of the drop member 33. Axial play is adjusted by a collar 45 which is fixed to the start post support rod 32 by usual means such as a set screw.

It is important for electrical continuity that the metal drop member 33 be rigidly attached mechanically to the metal start post support rod 32 by soldering or welding. In operation, given in more detail later, a slight but purposeful movement of the metal trigger lever 35 in response to the motion arrow of lever 37 will release the drop member 33. Thus the entire rigid pendulum assembly is able to fall and swing under gravity forces as a compound pendulum, in the process releasing the gravity driven cars to gravitational acceleration. Because of the natural smoothness of the pendulum swing at 1 G of acceleration, the cars will begin an unimpeded acceleration of approximately 0.5 G, and without gate slap car jostling, the acceleration onset is well defined.

Start Switch Electrical Description—FIGS. 2,3,4,5, 6, and 8.

FIG. 5 shows a side view and FIG. 6 shows an end view of the start gate, as mentioned comprising the pendulum assembly and the trigger lever. Most of the reference numbers have already been identified in the preceding mechanical description. Suppose the drop member 33 and the rest of the pendulum assembly are stationary as supported by the vertical solid line outline of the trigger lever 35. The weight 36 helps ensure the vertical as the normal equilibrium position for the trigger lever 35. The metal to metal contact between the end of the drop member 33 and the trigger lever 35 is firm. The firmness is ensured by concentrating the weight of drop member 33 to its thin and sharp right end by cutting out the center part 51 and adding the weight 34. A terminal assembly 41 comprises a block 42 and screws 43 and 50. An electric bias current can flow normally uninterrupted between terminal points 43 and 50. From terminal screw 43, the current flow is up through a twisted metal strip 44, the top end of which is under tension and thus makes rubbing electrical contact with the metal start post support rod 32. As discussed in the last section in FIG. 4, the start post support rod 32 is mechanically attached to the drop member 33, the combination electrically insulated by an appropriately placed plastic bushing 46 and washer 48. Note also the phantom outline of the twisted metal strip 44 in FIG. 4.

Back to FIG. 5, the current from the drop member 33 passes through the contact with the trigger lever 35, and in FIGS. 6 and 8 we see that the shoulder bolt 60 is extended through a hole in trigger lever 35 and is thus in metallic contact with same. Here also the path just described is electrically insulated by an appropriately placed plastic bushing 55 and washer 56. A collar or a nut 58, against a metal washer 57, is fixed on the end of the shoulder bolt shaft 60 and adjusted for a predetermined amount of play in the trigger lever 35. The bolt head 54 is soldered or otherwise electrically connected with wire 52 completing the electrical path to terminal screw 50.

Start Switch Electrical Operation—FIG. 7

As just described, a normally closed switch is thus formed from the trigger lever and drop member contact along with appropriate wiring and select placement of insulation. The enlarged view in FIG. 7 allows one to appreciate what happens during operation. Notice the contact area 53 where the tip of the drop member 33 touches the trigger lever 35 top. The drop member bottom is thin and sharp compared to the relatively broad top of the trigger lever to ensure reliable contact. Imagine, in slow motion, that when trigger lever 35 top is moved to the right, there is a point when only a few metal atoms of lever 35 are supporting a few metal atoms of member 33. This overlap distance for the contact area 53 is then on the order of a few billionths of a centimeter, yet a small amount of electrical bias current can still flow. When the two metal pieces separate as the drop member drops downwards, there is then essentially zero time between the 1 G acceleration motion obtained by member 33's tip and the cessation of current flow. Thus the contact opening signal sent to the timer, at a good fraction of the speed of light, is simultaneous with the drop member motion under gravity.

Again, in slow motion, consider the initial twisting torque applied to the pendulum assembly because of its inertia and the force of weight 34 acting over a lever arm distance of about 5 cm to its pivot point. The twisting motion will be propagated first to the left down the drop member to the start post support rod 32, then to the base of start post 22 and then up the post to the point where the start post touches the car nose. The twist motion could have components of both transverse and longitudinal acoustic wave propagation, which in common metals like steel or iron are both approximately 500,000 cm per second. The point where the car nose touches the start post is a distance of about 10 cm through connecting metal to the right tip of member 33. Therefore, the car nose is released to gravitational acceleration approximately 20 millionths of a second after the timer is started, assuming instant electrical communication.

DETAILED DESCRIPTION OF ALTERNATE EMBODIMENTS—FIGS. 9-11

Figure 9:
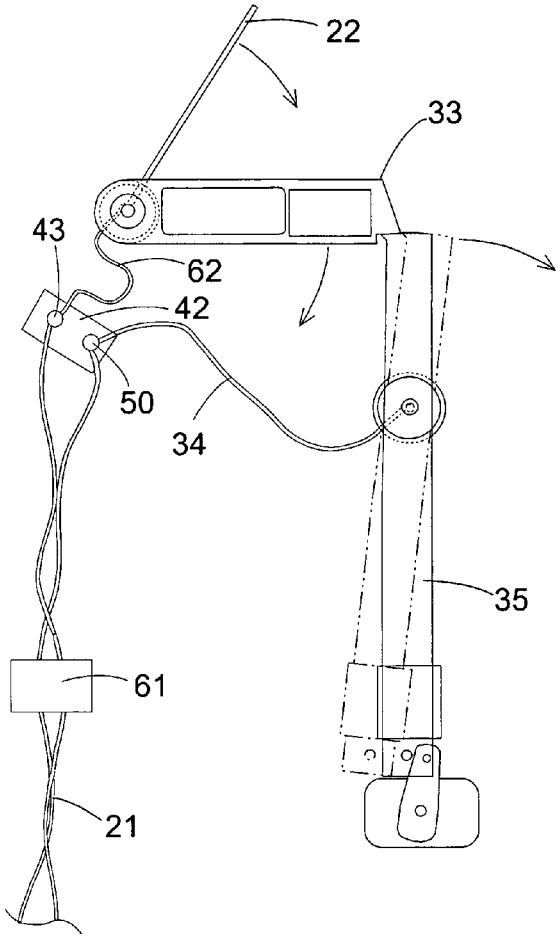
FIG. 9 shows another method for making electrical contact with the start post support rod.
Figure 10:
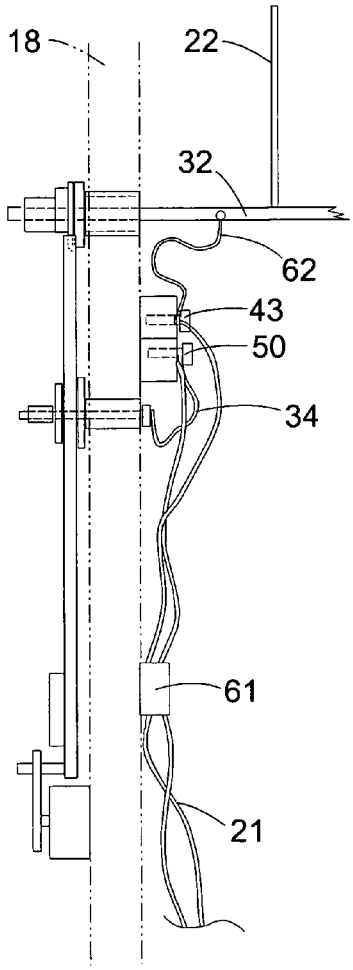
FIG. 10 shows a side view of FIG. 9.

As a first alternative embodiment the side view FIG. 9, and end view FIG. 10, show that the twisted metal strip 44, with rubbing contact against the post support rod 32, may be replaced with a wire 62 soldered directly to the support rod 32. Either method should suffice to ensure reliable electrical contact without applying undue torque that would retard the pendulum motion of the drop member, start post support rod, and start posts themselves. The rubbing friction from strip 44 is applied too close to the pivot axis of the rod 32 to cause significant torque. And, in case of a wire 62 soldered to the support rod 32, the wire movement during pendulum motion would not cause significant torque for the same reason.

A second embodiment includes the addition of a signal inverter 61 in the leads from terminal assembly 41 before they continue to the timer as the wire pair 21. Some of the commercially available timers used in gravity driven model racing may not accept opening of a normally closed contact as a valid input trigger. Such timers require a normally open contact going closed to start the timer. For these, a signal inverter can be used as shown. The signal inverter is a common flip-flop type of electrical device that will give an open output as long as its input is in a normally conducting or closed state. This is usually accomplished by sending a very small bias current through the normally closed input contacts. And, when the inverter input switches to an open non-conducting state, the interruption of its bias current causes the inverter output to immediately flip to a conducting state, just as when a normally open switch closes.

Figure 11:
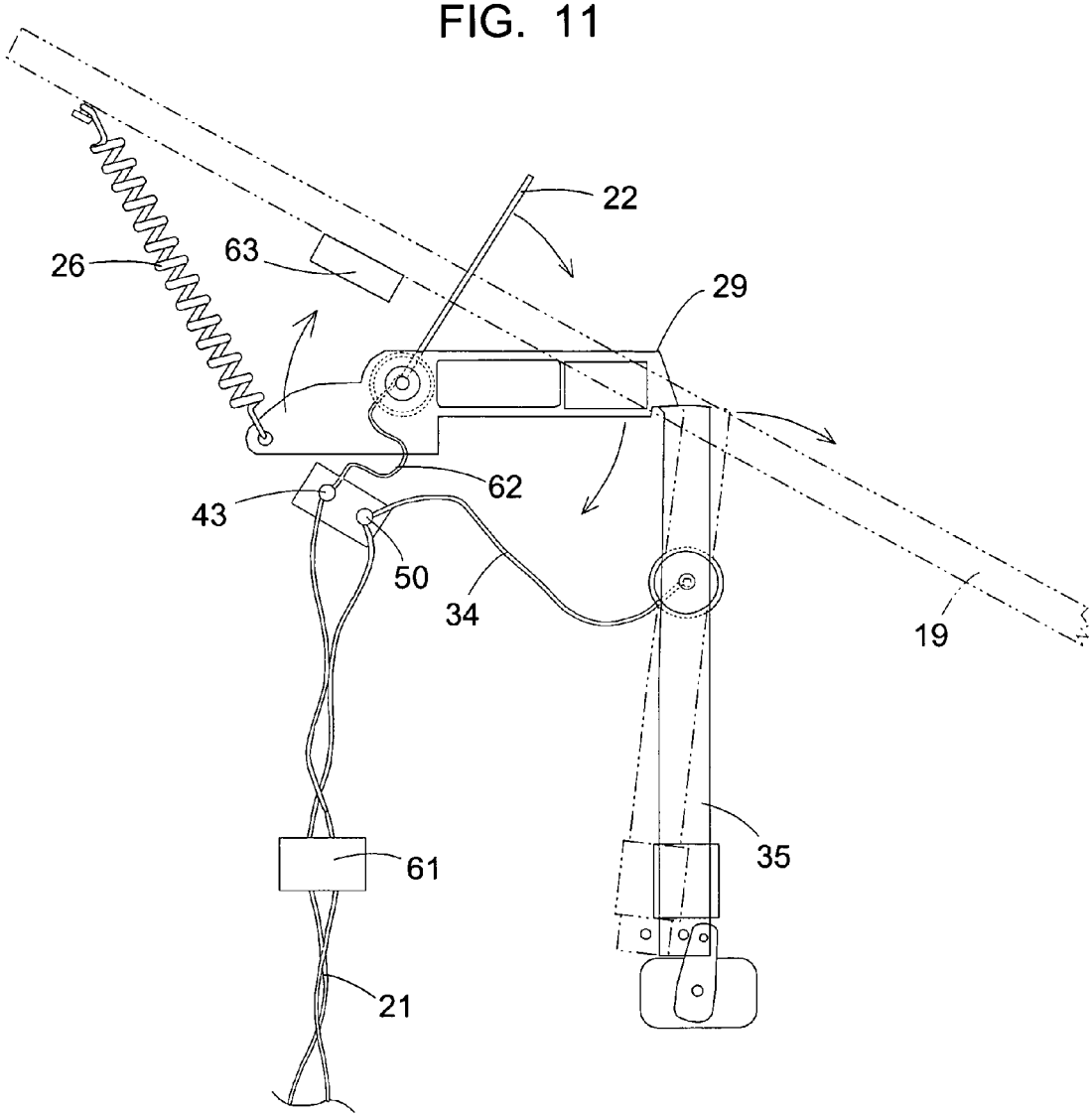
FIG. 11 shows a side view of FIG. 9 that includes a spring assisted drop member.

A third embodiment is shown in FIG. 11. This embodiment shows that the normally closed configuration of a drop member 29 and trigger lever can still be used as a timer start switch even with a prior art type spring 26 added as shown. The timer will start precisely when the car G force is applied as in the preferred embodiment, but the strong track vibration when the start gate is stopped, even by an impact cushion 63, still interferes with a smooth start by jostling the cars.

CONCLUSIONS, RAMIFICATIONS, AND SCOPE

The reader can see that the described embodiments of the improved electrical switch will allow a race timer to start substantially closer to the proper moment when gravity acceleration of the car begins. The separation of the drop member from the top of the trigger lever is the gravity turn on switch when car motion begins. This identical separation, then, can also serve as the timer turn on switch. As can be seen from the specification description, for this to be possible unusual attention must be paid to ensuring electrical continuity among the several mechanical parts of the start gate. Also, insulating bushings and washers must be placed at appropriate points to isolate the electrical path.

Prior art start gate builders simply did not care about the fine points of ensuring high precision between gravity acceleration onset and timer start. Most race timers are usually sold separately from the commercial race tracks that incorporate start gates. The levered micro switch became a quick and convenient interface in applying a timer from a large commercial selection to a wide commercial variety of tracks. But this invention, in combination with Ser. No. 12/321,320, can also be easily retrofit into existing commercial tracks.

A few prior art timer starters use a light beam shut off by the car noses. But these use after-the-start motion rather than its onset, also giving a false start time. And, the shape of a car nose may affect how the light beam is interrupted, thus affording an unfair advantage to some cars.

A model pinewood derby car will travel at about 480 cm/sec or about 11 mph if started at a 4 foot elevation. In one millisecond (ms), the distance traveled is 0.48 cm or about 3/16 inch. We have measured prior art type start micro switches and found that the start time errors can show a bias of about 10 ms and a standard deviation of about 4 ms. The bias is the average time delay between the application of gravity acceleration to the car and the timer start electrical signal. The standard deviation is a measure of the random time errors in the timer start signal. On the average the prior art start time is thus delayed by an amount that is equivalent to 1.9 inches car travel at the finish line with a standard deviation of plus or minus ¾ inches. For several cars released simultaneously, they all suffer the same timer start delay relative to gravity force onset, which would not be a factor in which one wins the single heat. But in repeat races of a single car to get a time average to separately compare with single race averages of other competing cars, the random error of plus or minus ¾ inch is indeed a factor in which one wins. And when one is trying to fine tune the performance of a single car through repeat runs, the ¾ inch error is a very significant factor. Also, when one is comparing a simulator theoretical time to an experimental time, the whole 1.9±¾ inches is a factor. In terms of car lengths at the finish of a 7-inch long model car, this error ranges from 16% to 38% of a car length. These errors are substantial, and with the present invention, they can be reduced to only 20 millionths of a second mechanical delay or 0.004 inches at the finish line. The electrical signal delay is of no consequence, as it travels at ⅔ the speed of light in the wiring.

This application is an extension of an already filed related application Ser. No. 12/321,320. In that application, it is shown that prior art builders also did not appreciate the unnecessary variance in race start times caused by using strong springs to open their start gate. And there it is shown that the drop member and trigger lever arrangement used to drop the pendulum assembly can substantially improve the race time repeatability by allowing a smooth controlled start. Thus the previously-filed application and this present application improve respectively the mechanical and electrical precision of the race start. Thus, the pendulum-based start gate can be used to improve timing start even if a prior art micro switch is used. And the use of the drop member and trigger lever separation as a start signal can improve start time accuracy even if the prior art spring activation is used. The best timing start precision, however, is to apply both inventions in combination as in the preferred embodiment here as supported by related application Ser. No. 12/321,320.

While the above invention contains many specificities, these should not be construed as limitations on the scope of any other possible embodiments, but rather as examples of the presently presented embodiments. Thus the scope of the invention should be determined by the appended claims and their legal equivalents, and not by the descriptive examples given. For example, the electrical connections may be modified somewhat from those showed in the preferred or alternate embodiments without changing the basic concept of the invention.

I claim:

1. An improved start gate timer trigger, for one or a plurality of gravity-driven cars, wherein;

(a) said start gate timer trigger comprising a holding member which is a metallic trigger lever making a mechanical contact with and supporting a metallic drop member, said trigger lever and said drop member being electrically wired and appropriately insulated so that said mechanical contact is also a fully functional normally closed electrical contact for starting an external race timer;

(b) said trigger lever being arranged to act on demand to open said normally closed contact with said drop member by allowing a contact point on said drop member to undergo a separation from a mutual contact point on said trigger lever when said drop member is allowed to drop thereby opening said normally closed electrical contact and thereby causing said race timer to start with substantially zero time delay after said separation;

(c) said drop member also being rigidly connected to a pivoted and insulated metallic start post support rod which has a plurality of starting posts rigidly attached such that when said drop member undergoes said contact point separation from said trigger lever contact point by dropping, said start post support rod begins rotating causing said plurality of attached starting posts to also be urged to rotate, thus allowing an onset of gravitational acceleration to begin a movement of said cars;

(d) whereby said onset of gravitational acceleration and beginning of said car movement relative to said external race timer start thus being delayed only by a mechanical movement propagation time from said drop member to said starting posts, said propagation time amounting to only several tens of millionths of a second, thus said external race timer start time agreeing with said onset of gravitational acceleration time with an accuracy improved by a very large factor compared to a millisecond range accuracy shown by start gate timer triggers that employ micro switches.

2. Said improved start gate timer trigger of claim 1 wherein a preferred embodiment is defined whereby electrical continuity starts with a first terminal screw and continues through a metal strip extending from said first terminal screw for a substantially short distance at which point said metal strip touches said metallic start post support rod with an electrical rubbing contact, said support rod in turn being affixed to and in electrical continuity with said metallic drop member, thereby defining an electrically conductive path from said first terminal screw to said metallic drop member.

3. Said improved start gate timer trigger of claim 2 wherein said preferred embodiment further providing electrical continuity which starts with a second terminal screw and continues through a wire extending from said second terminal screw a certain distance at which point said wire being connected to an insulated metal shoulder bolt, said bolt acting as a pivot axis for said trigger lever and said bolt being in electrical continuity with said metallic trigger lever, thereby defining an electrically conductive path from said second terminal screw to said metallic trigger lever.

4. Said improved start gate timer trigger of claim 1, wherein an electrical signal inverter is added for connecting to a timer that can accept only contact closure from a normally open switch to start timing.

* * * * *